US005659853A

United States Patent [19]

Matsuda et al.

[11] Patent Number: 5,659,853

[45] Date of Patent: Aug. 19, 1997

[54] ELECTRICALLY CHARGING METHOD AND ELECTRICALLY CHARGING DEVICE USED THEREFOR

[75] Inventors: Masanori Matsuda; Eiji Goto; Akinori Nishida; Hironaga Iida; Masahiro Shirai, all of Osaka, Japan

[73] Assignee: Mita Industrial Co., Ltd., Osaka, Japan

[21] Appl. No.: 313,792

[22] Filed: Sep. 28, 1994

[30] Foreign Application Priority Data

Sep. 30, 1993 [JP] Japan ..... 5-245047
Oct. 19, 1993 [JP] Japan ..... 5-261070

[51] Int. Cl.[6] ..... G03G 15/02

[52] U.S. Cl. ..... 399/176; 361/221; 361/225

[58] Field of Search ..... 355/219; 361/221, 361/225; 399/100, 174, 175, 176

[56] References Cited

U.S. PATENT DOCUMENTS

| | | | |
|---|---|---|---|
| 3,935,517 | 1/1976 | O'Brien | 317/262 A |
| 5,148,219 | 9/1992 | Kohyama | 355/219 |
| 5,196,892 | 3/1993 | Mitsuaki | 355/269 |
| 5,206,682 | 4/1993 | Yamada et al. | 355/200 |
| 5,243,387 | 9/1993 | Ikegawa | 355/219 |
| 5,278,614 | 1/1994 | Ikegawa | 355/219 |
| 5,384,626 | 1/1995 | Kugoh et al. | 355/219 |
| 5,483,323 | 1/1996 | Matsuda | 355/219 |
| 5,532,795 | 7/1996 | Tatsumi | 355/210 |

FOREIGN PATENT DOCUMENTS

| | | |
|---|---|---|
| 0308185 | 3/1989 | European Pat. Off. . |
| 0341900 | 11/1989 | European Pat. Off. . |
| 0562857 | 9/1993 | European Pat. Off. . |
| 0590912 | 4/1994 | European Pat. Off. . |

*Primary Examiner*—William J. Royer
*Attorney, Agent, or Firm*—Sherman and Shalloway

[57] ABSTRACT

A method of electrically charging a material to be charged by bringing a charging member impressed with a voltage into physical contact with the material to be charged, wherein the charging member is constituted by a flexible and electrically conducting endless sheet and a rotary insulating brush which supports the endless sheet at a position where the endless sheet and the material to be charged are in contact with each other and gives a pushing force to the endless sheet, and the endless sheet is driven actively or passively together with the insulating brush at a speed substantially in synchronism with the material to be charged while applying a charging voltage to the endless sheet. This method makes it possible to uniformly and stably charge the surface of the photosensitive material even when defects such as pinholes or the like exist in the surface of the photosensitive material, without causing the life of the photosensitive material to be shortened.

2 Claims, 5 Drawing Sheets

ELECTRICALLY CHARGING METHOD AND ELECTRICALLY CHARGING DEVICE USED THEREFOR

BACKGROUND OF THE INVENTION

1. Field of the Invention

The present invention relates to an electrically charging method which is capable of mainly charging the surface of a photosensitive material without relying upon the corona discharge, and to an electrically charging device used therefor.

2. Description of the Prior Art

In an electrophotographic method, an image is formed by uniformly charging the surface of a photosensitive material, exposing a document image to light to form an electrostatic latent image that corresponds to the document image on the surface of the photosensitive material, developing the electrostatic latent image and transferring the developed image.

In the above-mentioned method of forming image, in general, the surface of the photosensitive material is electrically charged (mainly charged) by the corona charging accompanied, however, by the generation of ozone which is a cause of environmental pollution. In order to avoid the generation of ozone in recent years, methods have been proposed for mainly charging the surface of the photosensitive material by bringing an electrically conducting rubber roller into frictional contact with the surface of the photosensitive material while applying a bias voltage (Japanese Laid-Open Patent Publications Nos. 149889/1988 and 287887/1989).

According to the above-mentioned charging method based upon the frictional contact, however, the uniformity in the electric charge is lost when foreign matters such as dust, paper powder and the like are trapped between the electrically conducting rubber roller and the photosensitive material and it becomes difficult to stably carry out the electric charging. Moreover, when the surface of the photosensitive material is not perfectly cleaned permitting the toner to stay on the surface, then the remaining toner is adhered to the surface of the photosensitive material during the formation of image causing the photosensitive material to lose its durability. Furthermore, uniform charging of the photosensitive material is not accomplished by the application of a DC bias voltage only unless an AC bias voltage is applied in combination.

In order to solve the above-mentioned problem, the present applicant has previously proposed a method of electrically charging the photosensitive material by bringing a flexible electrically conducting sheet into frictional contact with the surface of the photosensitive material by using an electrically conducting brush roller while applying a DC voltage to the roller (see Japanese Patent Application No. 88148/1992).

This charging method is very meaningful in that since the flexible electrically conducting sheet is depressed by an electrically conducting brush roller to come into intimate contact with the surface of the photosensitive material, the electric charging by friction is uniformly carried out by the application of a low DC bias voltage only without the need of applying an AC bias voltage. According to this charging method in which a charging voltage is applied to the electrically conducting sheet from the ends of the electrically conducting brush, however, the presence of defects such as pinholes in the surface of the photosensitive material permits the electrically conducting sheet to come into contact with the pinholes, so that heavy currents flow into the pinholes from the ends of the electrically conducting brush. Flow of such heavy currents brings about undesirable formation of holes in the electrically conducting sheet to which the ends of the brush are in contact. Accordingly, there develop dot-like high-potential portions causing the photosensitive material to be defectively charged.

SUMMARY OF THE INVENTION

The object of the present invention therefore is to provide an electrically charging method of a type in which a material to be charged such as a photosensitive material is electrically charged by bringing a flexible electrically conducting sheet impressed with a charging voltage into physical contact with the material to be charged, wherein despite there exist defects such as pinholes in the surface of the photosensitive material, the electric charging is carried out uniformly and effectively without causing the output of the power source to drop.

According to the present invention, there is provided a method of electrically charging a material to be charged by bringing a charging member impressed with a voltage into physical contact with the material to be charged wherein:

the charging member is constituted by a flexible and electrically conducting endless sheet and a rotary insulating brush which supports the endless sheet at a position where said endless sheet and said material to be charged are in contact with each other and gives a pushing force to said endless sheet; and said endless sheet is driven actively or passively together with the insulating brush at a speed substantially in synchronism with the material to be charged while applying a charging voltage to said endless sheet.

The present invention further provides a device for electrically charging a material to be charged by bringing a charging member impressed with a voltage and a material to be charged into physical contact with each other wherein:

said charging member is constituted by a flexible, hollow and electrically conducting roller, an insulating brush roller provided in said hollow and electrically conducting roller in concentric therewith and a feeder mechanism for applying a charging voltage to said hollow and electrically conducting roller; and said hollow and electrically conducting roller and said insulating brush roller are driven together at a speed in synchronism with the material to be charged.

DETAILED DESCRIPTION OF THE INVENTION

According to the present invention, a distinguished feature resides in the use of an electrically insulating brush for bringing an endless and electrically conducting flexible sheet into forced contact with the surface of a material to be charged such as a photosensitive material. That is, the insulating brush does not at all take part in the application of a charging voltage to the electrically conducting flexible sheet. Therefore, even if pinholes may exist in the photosensitive material, it is allowed to avoid the flow of heavy currents from local portions such as from ends of the brush. Therefore, there does not develop such a trouble as formation of holes in the electrically conducting flexible sheet with which the ends of the brush are in contact, and defective charging due to the occurrence of dot-like high-potential portions is effectively prevented.

Merits owing to the combination of the insulating brush and the electrically conducting flexible sheet are inherited from the charging device that was previously proposed by the present applicant.

For instance, the electrically conducting sheet is flexible and is freely deformable. Therefore, even though the material to be charged may have a rugged surface, the electrically conducting sheet can be brought into uniform contact with the whole surface of the material to be charged. Besides, even if foreign matters such as dust, paper powder, residual toner and the like are adhered on the surface of the material to be charged, the electrically conducting sheet comes into uniform contact with the surfaces other than the portions where the foreign matters are adhered. Moreover, the individual ears of the insulating brush work as pushing springs; i.e., the insulating brush works as the finest and dense spring enabling the electrically conducting sheet to come into uniform and smooth contact with the material to be charged.

According to the present invention, furthermore, the hollow and electrically conducting roller and the insulating brush roller are actively or passively driven at a speed in synchronism with the material to be charged. Therefore, these rollers need not be separately driven using particular driving mechanism, which is very advantageous for realizing the device in a compact size.

(Charging Device)

The present invention will now be described in detail by way of a concrete example shown in the accompanying drawings.

Figure 1:
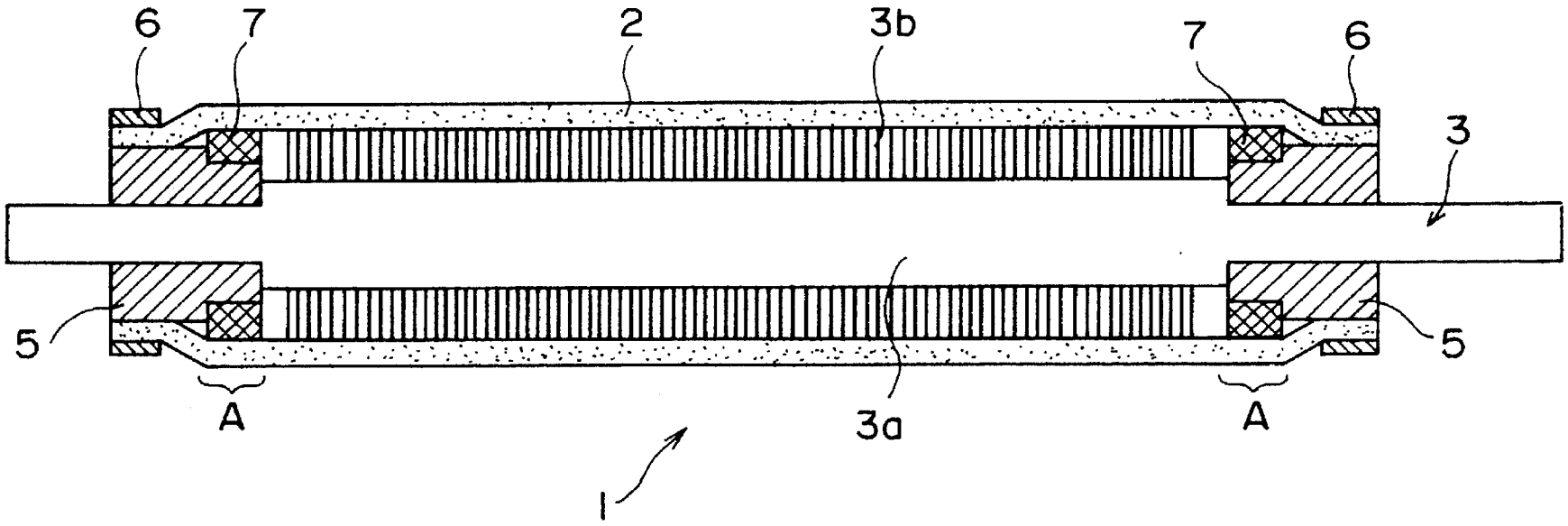
FIG. 1 is a side sectional view of a charging device of the present invention.
Figure 2:
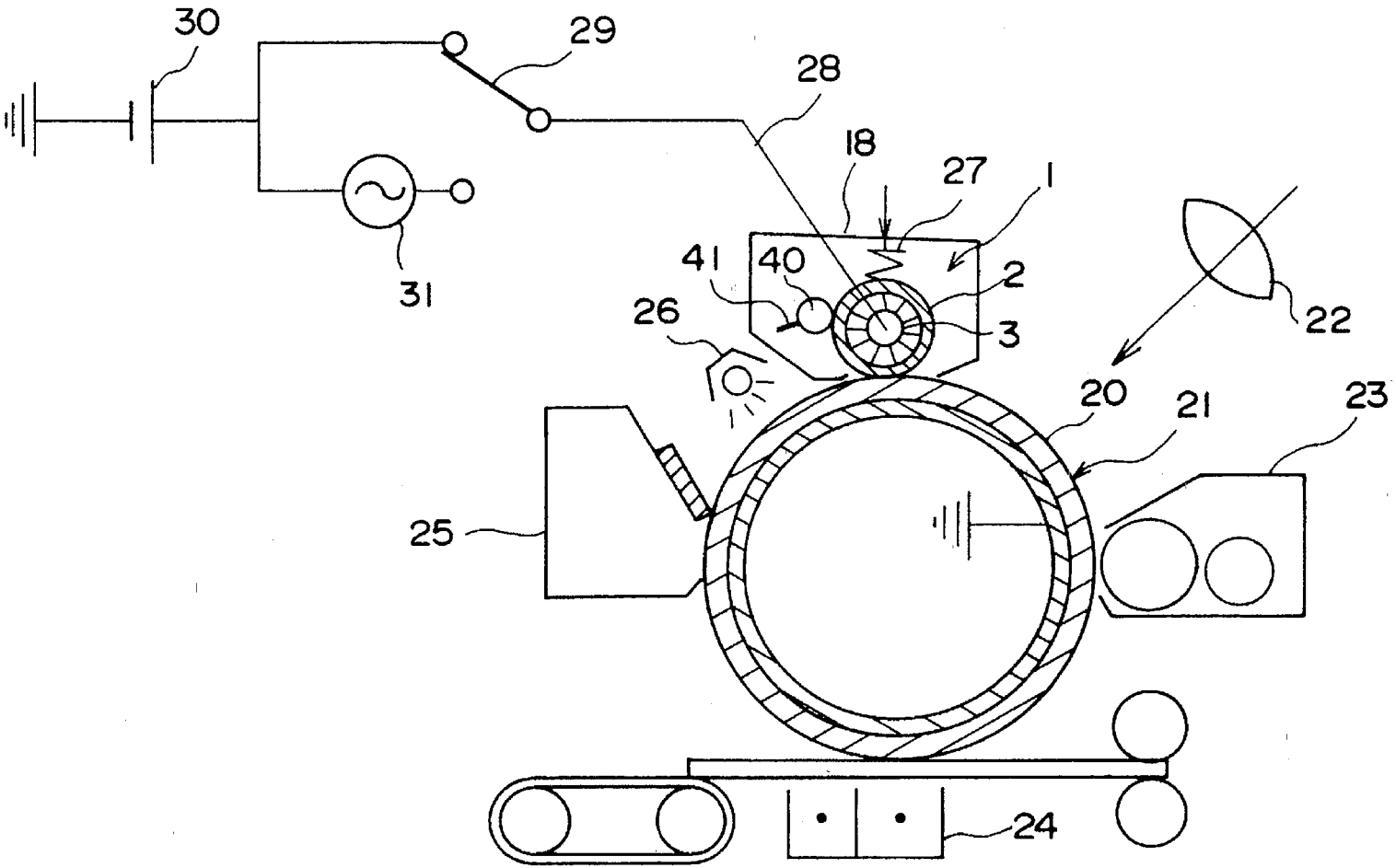
FIG. 2 is a diagram illustrating an example where the charging device of FIG. 1 is applied to an electrophotographic copying machine.

FIG. 1 is a side sectional view illustrating a contact charging device of the present invention, and FIG. 2 is a diagram of when the contact charging device of FIG. 1 is applied to an electrophotographic copying machine.

A charging device 1 of the present invention is constituted roughly by a flexible and hollow electrically conducting roller 2 and a brush roller 3 that is provided inside the roller 2 in concentric therewith.

The hollow electrically conducting roller 2 is made of a flexible and electrically conducting sheet of a seamless tubular shape, and the brush roller 3 is constituted by an electrically conducting shaft roller 3*a* and an insulating brush 3*b* implanted thereon. Both ends of the hollow and electrically conducting roller 2 are secured by rigid flange rings 5 of the electrically conducting shaft roller 3*a*.

The flange rings 5 are secured by key grooves or the like means to the shaft roller 3*a* as a unitary structure, so that the hollow and electrically conducting roller 2 and the brush roller 3 rotate at the same speed as a unitary structure. The flange rings 5 must be electrically conducting and are made of an electrically conducting metal such as aluminum. That is, by connecting a feeder mechanism to the electrically conducting shaft roller 3*a*, the charging voltage is applied to the hollow and electrically conducting roller 2 via the roller 3*a* and the flange rings 5.

The hollow and electrically conducting roller 2 (hereinafter often called simply "flexible sheet") is secured to the flange rings 5 by using suitable resin rings 6, by holding the ends of the sheet rings 6 and the flange rings 5, or by using a suitable adhesive agent. Securing the flexible sheet 2 to the flange rings 5 will be described later.

Desirably, furthermore, elastic rings 7 such as silicone rubber rings are provided at the ends on the inside of the flange ring 5, and the ends of the flexible sheet 2 are secured to the flange ring 5 in a manner to come into intimate contact with the elastic rings 7. With a suitable degree of tension being applied to the flexible sheet 2, therefore, the sheet is effectively prevented from being twisted when it is brought into physical contact with the surface of the material to be charged such as the photosensitive drum. On the upper surface regions A of the flexible sheet corresponding to the elastic rings 7, the sheet 2 comes into intimate contact with the end portions of the material to be charged, and the flexible sheet 2 and the brush roller 3 are driven as a unitary structure following the movement of the material to be charged. Therefore, there is no need of providing any particular drive mechanism for rotating the flexible sheet 2. It is further desired to so select the hardness of the elastic rings 7 that the contact width between the flexible sheet 2 and the surface of the material to be charged becomes usually from about 2 to about 10 mm.

Figures 4A, 4B:
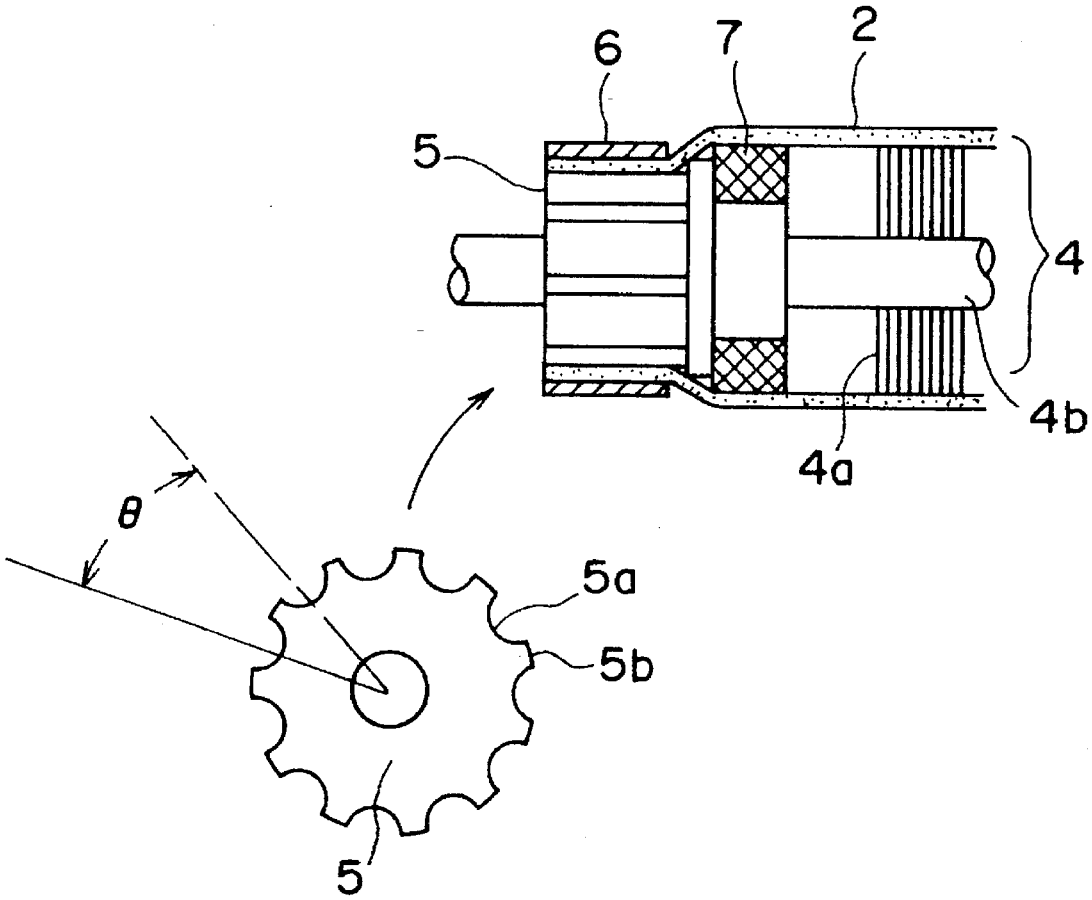
FIG. 4A is a diagram illustrating a flange ring that is desirably used for the charging device of FIG 1.
FIG. 4B is an end view of the flange ring of FIG. 4A.

In the present invention, furthermore, the flexible sheet 2 is secured to the flange rings 5 by using resin rings 6 as mentioned earlier. In this case, as shown in FIG. 4, there are used flange rings 5 having many protruded portions and recessed portions formed in the surface thereof and resin rings 6 having an inner diameter that is larger than the diameter of the flange rings 5 by approximately the thickness of the flexible sheet 2. The ends of the flexible sheet 2 are held between the rings 6 and the flange rings 5, so that the sheet 2 is secured. In securing the flexible sheet 2, the ends of the sheet 2 are squeezed. However, wrinkles formed at the ends are absorbed by the recessed portions 5*a* of the flange rings 5 and do not extend up to the effective charging region of the flexible sheet 2.

In the flange ring 5, the angle θ subtended by the neighboring recessed portions 5*a* should usually be set within a range of from 15 to 90 degrees though it may vary depending upon the size of the flange ring 5. When this angle is too great, it becomes difficult to effectively secure the flexible sheet 2. When the angle is too small, on the other hand, it becomes difficult to effectively absorb wrinkles. It is further desired that the flange ring 5 has an outer diameter that is set to from about 0.75 to about 0.9 times as great as the diameter of the brush roller 3. When the outer diameter of the flange ring 5 is larger than the above range, it becomes difficult to sufficiently squeeze the flexible sheet 2; i.e., sufficient tension is not applied to the flexible sheet 2 which results in a cause of slack. When the outer diameter of the flange ring 5 becomes smaller than the above range, on the other hand, the flexible sheet 2 is squeezed too greatly that wrinkles are formed to a large degree and are no longer sufficiently absorbed by the recessed portions 5*a*. Moreover, the protruded portions 5*b* of the flange ring 5 may be tapered to some extent, so that the flexible sheet 2 is smoothly secured by the resin rings 6.

The inner diameter of the resin ring 6 has been set to be larger than the outer diameter of the protruded portions 5*b* of the flange ring 5. In this case, a heat-shrinking resin may be used to secure the flexible sheet 2 by utilizing the heat-shrinking property of the resin. To prevent the leakage of current, furthermore, the resin ring 6 should have a volume resistivity of not smaller than $10^{15}$ Ω-cm.

Further, in the present invention, by utilizing the elastic ring 7, the end portion of the flexible sheet can be fixed without using the resin ring 6 or forming a rugged surface in the flange ring 5. The method of fixing the flexible sheet 2 by utilizing the elastic ring 7 is shown in FIG. 5(*a*) and FIG. 5(*b*).

Figure 5A:
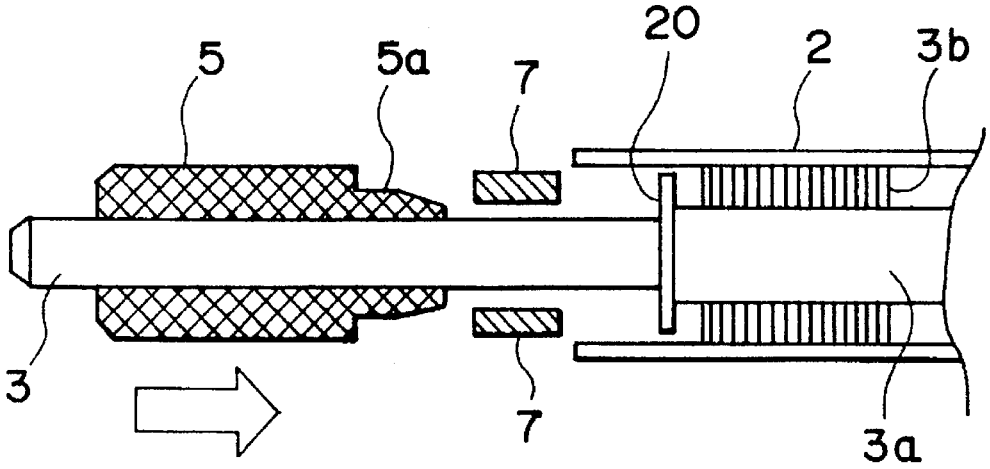
FIGS. 5(*a*) and 5(*b*) are views showing one example of a method of fixing an electroconductive flexible sheet 2.
Figure 5B:
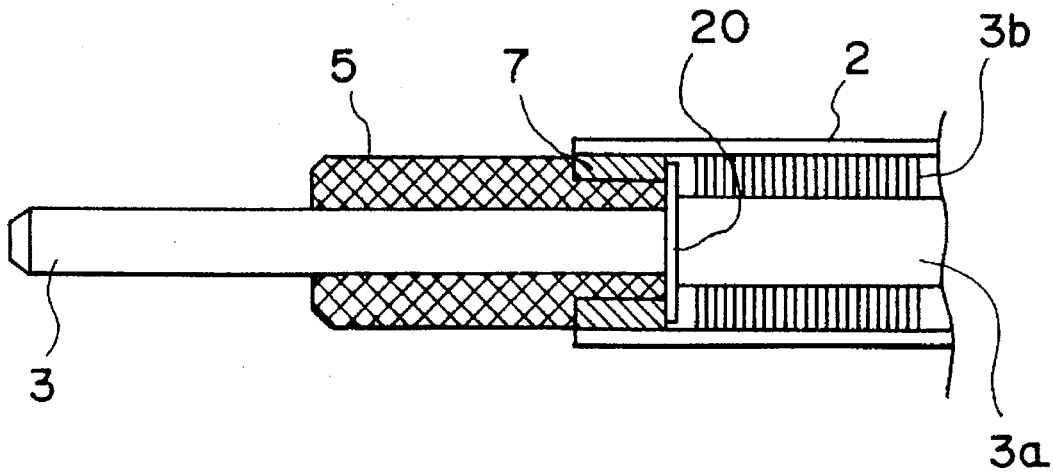

As shown in FIG. 5(*a*), a pressing plate 20 is provided in the end portion of the shaft roller 3*a*, and in this state, the elastic ring 7 is inserted in the flexible sheet 2 through the shaft 3. In this case, the outer diameter of the elastic ring 7 is made somewhat smaller than the inside diameter of the flexible sheet 2. Generally, there may be used the elastic ring 7 having an outer diameter smaller than the inside diameter of the flexible sheet 2 by about 0.5 to 0.1 mm. Then, the flange ring 5 having a small-diameter portion 5*a* is inserted in the elastic ring 7 through the shaft 3. Here, by somewhat enlarging the outer diameter the small-diameter portion 5*a* more than the inside diameter of the elastic ring 7, the insertion of the small-diameter portion 5*a* makes the elastic ring 7 in an outwardly broadened condition. Thus, as shown in FIG. 5(*b*), the inner surface of the end portion of the flexible sheet 2 is intimately adhered to the elastic ring 7, and firmly fixed. Furthermore, the flange ring 5 is fixed to the shaft 3 by means of a pin.

In such a fixing method, the forward end of the small-diameter portion 5*a* of the flange ring 5 is desirably tapered. This makes it possible to easily insert the small-diameter portion 5*a* in the elastic ring 7. Furthermore, the end portion of the flexible sheet 2adheres intimately with the elastic ring 7 and does not directly contact the flange ring 5. Accordingly, to apply voltage to the flexible sheet 2, an electrically conductive rubber may be used as the elastic ring 7. Of course, when the end portion of the flexible sheet 2 is further extended more than the adhering portion of the elastic ring 7 and is adhered intimately to the flange ring 5 by using the resin ring 6, the elastic ring may be insulated.

Referring to FIG. 2 illustrating an example where the charging device of FIG. 1 is applied to an electrophotographic copying machine, a rotary drum 21 equipped with an electrophotosensitive layer (material to be charged) 20 is surrounded by charging device 1, an image exposing mechanism 22, a developing mechanism 23, a toner transfer mechanism 24, a cleaning mechanism 25, and an exposure discharging mechanism 28.

The charging device 1 as a whole is contained in, for example, a box 18 of which the one surface is open, and is brought with a predetermined pressure into contact with the photosensitive drum 21 by such means as a pushing spring 27 or the like. The charging device 1 is further provided with a cleaning roller 40 made of a sponge or the like that comes into contact with the outer surface of the flexible and hollow electrically conducting roller 2 to remove foreign matters such as toner and the like adhered on the roller 2. The foreign matters recovered by the cleaning roller 40 are scraped off by a scraper 41.

The electrically conducting shaft roller 3*a* inside the hollow and electrically conducting roller 2 is electrically insulated from the machine frame or the drive system, and is connected to a DC power source 30 and to a pulsating charging power source 31 through a collector (not shown), a wiring 28 and a change-over switch 29.

When the photosensitive layer 20 is electrically charged using the charging device of the present invention, the electric charging is uniformly accomplished without causing the layer 20 to be worn out. By exposing a document image to light, therefore, there is formed an electrostatic latent image maintaining a high contrast without disturbance, and a copy is obtained maintaining a high density and excellent image quality through the subsequent developing and transfer operations.

In the present invention, the flexible and electrically conducting sheet constituting the hollow and electrically conducting roller 2 should have a volume resistivity of, generally, from not larger than $10^7$ Ω-cm and, particularly, not larger than $10^6$ Ω-cm. That is, when the volume resistivity is larger than the above range, it becomes difficult to uniformly and effectively charge the surface of the photosensitive material. Furthermore, the flexible and electrically conducting sheet may be made of any material as far as it has electrically conducting property and flexibility. In general, use is made of a resin or a rubber blended with a variety of electric conduction-imparting agents, or a metal foil.

Examples of the resin include various thermoplastic elastomers such as polyester elastomer, polyamide elastomer, polyurethane elastomer, soft vinyl chloride resin, styrene-butadiene-styrene block copolymer elastomer, and acrylic elastomer, as well as polyamides, copolyamides or modified products thereof such as nylon 6, nylon 6,6, nylon 6-nylon 6,6 copolymer, nylon 6,6-nylon 6,10 copolymer and methoxymethylated nylon, silicone resin, acetal resin such as polyvinyl butyral, polyvinyl acetate, ethylene-vinyl acetate copolymer, and ionomer. Examples of the rubber include natural rubber, butadiene rubber, styrene rubber, butadiene-styrene rubber, nitrile-butadiene rubber, ethylene-propylene copolymer rubber, ethylene-propylene-non-conjugated diene copolymer rubber, chloroprene rubber, butyl rubber, silicone rubber, urethane rubber and acrylic rubber.

In addition to the above-mentioned examples, there can be further preferably used a fluorine-containing resin or rubber such as polyvinylidene fluoride (PVDF), polytetrafluoroethylene (PTFE), tetrafluoroethylene-hexafluoropropylene copolymer (PTFE. HFP) or fluorine-containing perfluoroalkoxy resin. Use of these fluorine-containing resins or rubbers which are inert and have small coefficients of friction, gives a great advantage from the standpoint of life of the photosensitive material and life of the sheet.

In order to adjust the volume resistivity, the resin or the rubber is blended with an electric conduction-imparting agent such as electrically conducting carbon black or a metal powder such as of silver, gold, copper, brass, nickel, aluminum or stainless steel, powdery electric conduction-imparting agent such as of tin oxide, or non-ionic, cationic, anionic or amphoteric organic electric conduction-imparting agent, or an organic tin-type electric conduction-imparting agent. A higher electrically conducting property is obtained when the electric conduction-imparting grains are forming a chain structure in the resin or in the rubber. In this case, however, dot-like high-potential portions may generate when a voltage is applied giving rise to the occurrence of irregular electric charging. It is, therefore, desired that the electric conduction-imparting agent is uniformly and finely dispersed in the resin or in the rubber. For this purpose, the resin or the rubber blended with the electric conduction-imparting agent must be kneaded to a sufficient degree. The electric conduction-imparting agent can be uniformly and effectively dispersed by partly using an acid-modified resin or rubber obtained by being copolymerized with an ethylenically unsaturated carboxylic acid such as acrylic acid, methacrylic acid or maleic anhydride.

As a metal foil, furthermore, there can be used nickel, aluminum, copper, brass or tin that is obtained by the electroforming method or the extrusion.

The thickness of the flexible sheet 2 may vary depending upon the softness that is required but should generally be from 50 to 400 μm and, particularly, from 100 to 300 μm. The outer surface of the flexible sheet 2 should be as smooth as possible, and should have an average coarseness in compliance with JIS B0601 of not greater than 5 μm and, particularly, not greater than 1 μm.

In the present invention, the brush roller 3 is the one obtained by implanting the brush **4*b* of an electrically insulating fiber on the electrically conducting shaft roller 3*a* as mentioned earlier. The insulating brush should have a volume resistivity of not smaller than $10^{13}$ Ω-cm and, particularly, not smaller than $10^{14}$ Ω-cm. The brush fiber should have a size of from 2 to 10 denier (d) and, particularly, from 3 to 6 d and a fiber length (length of hair) of from 2 to 7 mm and, particularly, from 3 to 5 mm. Moreover, the hair density should be from 10,000 to 200,000 hairs/sq. in. and, particularly, from 30,000 to 100,000 hairs/sq. in. to produce smooth and uniform pushing force. Moreover, the ends of the brush should be rounded to suppress the wearing of the electrically conducting sheet 2**.

As the insulating fiber, there can be used a synthetic fiber or a regenerated fiber, i.e., a polyamide fiber such as nylon 6, nylon 6,6, a polyester fiber such as polyetylene terephthalate, or acrylic fiber, polyvinyl alcohol fiber, polyvinyl chloride fiber, rayon, acetate, or the like.

When the brush **3*b* has electrically conducting property, in general, any defects such as pinholes in the surface of the photosensitive drum 1 permits local currents to flow from the ends of the brush 3*b* to the defective portions, causing the electrically conducting sheet to which the ends of the brush are in contact to be broken. When the brush 3*b* has electrically insulating property, on the other hand, the electric current flows from the flexible sheet 2**, whereby no local current flows and the above-mentioned trouble does not at all take place.

(Charging Method)

According to the charging method of the present invention, a charging voltage is applied to the electrically conducting flexible sheet to electrically charge it while moving the electrically conducting flexible sheet together with the electrically insulating brush roller at a speed in synchronism with the moving speed of the material to be charged (e.g., photosensitive layer).

Figure 3:
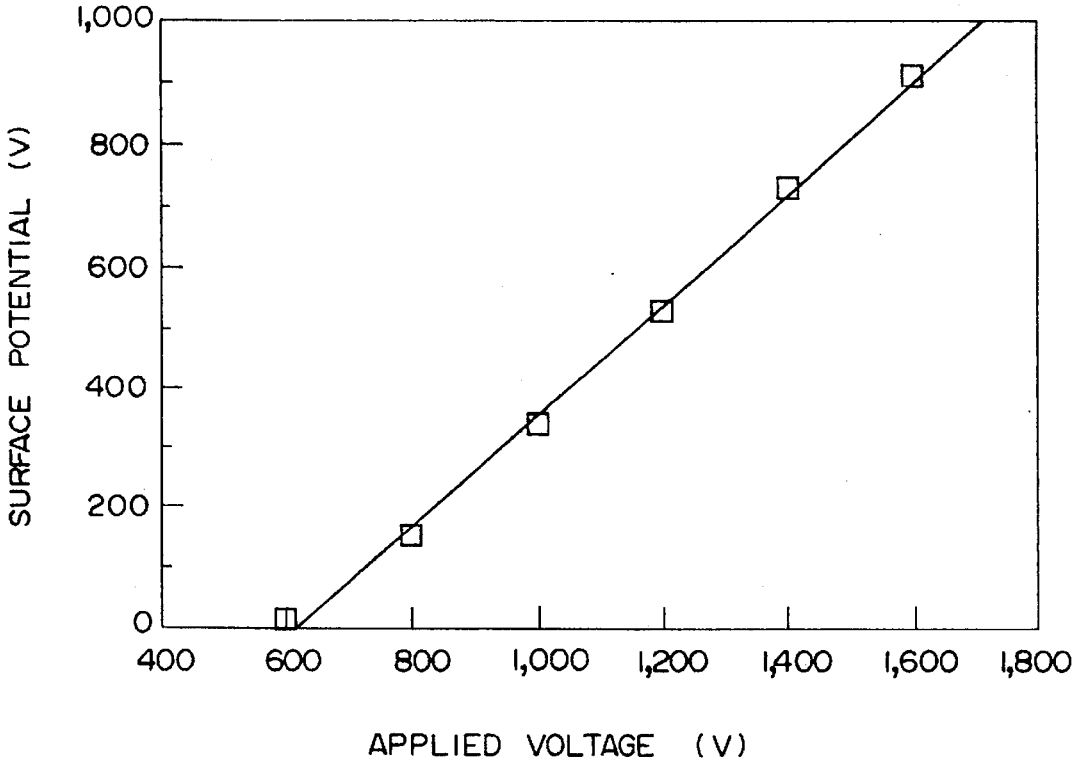
FIG. 3 is a diagram illustrating a relationship between the applied voltage and the surface potential of a photosensitive material when the charging method of the present invention is applied to an organic photosensitive material.

It is desired that the charging voltage applied to the flexible sheet 2 is set to from 1.5 to 3.5 times and, particularly, from 2 to 3 times as great as the charge start voltage on the surface of the material to be charged such as the photosensitive material. FIG. 3 is a diagram illustrating a relationship between the voltage applied to the electrically conducting flexible sheet 3 and the potential on the surface of the photosensitive layer 20 of when an organic photosensitive material is used while employing the charging method of the present invention. It will be obvious from FIG. 3 that a favorable linear relationship is maintained between the applied voltage and the surface potential in an effectively charging region. It will be understood from this fact that according to the charging method of the present invention, surface potential sensors may be arranged around the photosensitive material, and the applied voltage is adjusted based upon the surface potential detected by the sensors, in order to maintain the potential on the surface of the photosensitive material at a constant optimum value.

According to the present invention, the charging voltage is applied to the electrically conducting flexible sheet 2 without passing through the brush roller **3*b*. Therefore, even in case defects such as pinholes exist in the surface of the photosensitive layer 20, heavy currents do not flow and the surface of the photosensitive layer 20 is uniformly and effectively charged, which is a distinguished advantage of the present invention. Another advantage is that the electric charging is accomplished uniformly by using a DC voltage only. In order to more uniformly carry out the electric charging, the pulsating charging power source 31 may be combined with the DC power source 30** in order to apply a voltage obtained by superposing an AC voltage on the above-mentioned DC voltage. It is desired that the alternating current has a frequency of from 300 to 1500 Hz and, particularly, from 400 to 1000 Hz, and an interpeak voltage of from 2.5 to 4 times as great and, particularly, from 2.8 to 3.5 times as great as the charge start voltage.

The electrically charging method of the present invention is useful for electrically charging the photosensitive materials that are used for a variety of electrophotographic methods such as a copying machine, a facsimile, a laser printer and the like, and can be used for electrically charging a variety of photosensitive materials of single-layer and laminated-layer structures, such as an a-Si photosensitive material, a selenium photosensitive material, and single-layer and multi-layer organic photosensitive materials. When the charging method of the present invention is adapted to the organic photosensitive materials among the aforementioned photosensitive materials, ozone and NOx are produced in small amounts to little deteriorate a charge-generating pigment, a charge-transporting material, a binder and a dielectric that constitute the photosensitive material, enabling the life of the photosensitive materials to be lengthened. The charging method of the present invention is not limited to the electric charging in a narrow sense but can be further adapted to removing the electric charge by applying a bias voltage, as a matter of course.

EXAMPLE 1

The charging device of FIG. 1 was mounted on a copying machine modified from an electrophotographic copying machine DC-2566 produced by Mira Koryo Co. that uses an organic photosensitive material, in order to carry out the electric charging, exposure to light, developing, transfer and fixing without applying an AC voltage.

Properties of the members of the charging device and the charging conditions were as described below. The volume resistivity of the flexible and electrically conducting sheet (electrically conducting roller) was measured by using a volume resistivity measuring instrument ROEESTER manufactured by Mitsubishi Yuka Co. while applying a voltage of 10 V.

Electrically conducting roller:
- Material: polyurethane elastomer
- Thickness: 0.3 mm
- Volume resistivity: $2.8\times10^{6}$ Ω-cm
- Inner diameter of roller: 20 mm Brush roller:
- Material: insulating rayon ($1.0\times10^{15}$ Ω-cm)
- Outer diameter: 19.8 mm
- Fiber size: 6 denier
- Fiber length: 3 mm
- Hair density: 86,000 hairs/sq. in.

Charging conditions:
- Applied DC voltage: +1600 V (charge start voltage: +600 V)
- Number of revolutions of brush roller: 150 rpm (revolves following the photosensitive material)

Number of revolutions of the endless sheet: 150 rpm (secured to the brush roller and revolves following the photosensitive material)

Peripheral speed of the photosensitive material: 157 mm/sec.

When the photosensitive material having pinholes was electrically charged under the above-mentioned conditions, there occurred leakage of charging current to the pinholes but holes were not formed or the roller was not broken by the leakage from the ends of the brush.

When the photosensitive material without pinhole was electrically charged under the same conditions, the potential on the surface of the photosensitive material was +800 V and the obtained copy exhibited good image without black dot-like irregularities.

COMPARATIVE EXAMPLE 1

Experiment was conducted quite in the same manner as in Example 1 but using the following brush roller.

Brush roller;

Material; electrically conducting rayon

Outer diameter: 19.8 mm

Volume resistivity: $1.0\times10^3$ Ω-cm

Fiber size: 6 denier

Fiber length: 3 mm

Hair density: 100,000 hairs/sq. in.

When a photosensitive material having pinholes was electrically charged under the above-mentioned conditions, the charging current leaked into the pinholes, and holes were formed in the electrically conducting roller due to leakage from the ends of the brush.

When the photosensitive material without pinhole was electrically charged under the same conditions, the potential was +800 V on the surface of the photosensitive material and the obtained copy exhibited image with black dot-like irregularities.

We claim:

1. A device for electrically charging a material to be charged by bringing a charging member impressed with a voltage and a material to be charged into physical contact with each other wherein:

said charging member is constituted by a flexible, hollow and electrically conducting roller, an insulating brush roller provided in said hollow and electrically conducting roller concentric therewith and a feeder mechanism for applying a charging voltage to said hollow and electrically conducting roller; and said hollow and electrically conducting roller and said insulating brush roller are driven together at a speed in synchronism with the material to be charged;

wherein the hollow and electrically conducting roller is provided with a cleaning roller that comes into contact with the outer surface thereof, said cleaning roller being a sponge roller.

2. A device for electrically charging a material to be charged by bringing a charging member impressed with a voltage and a material to be charged into physical contact with each other wherein:

said charging member is constituted by a flexible, hollow and electrically conducting roller, an insulating brush roller provided in said hollow and electrically conducting roller concentric therewith and a feeder mechanism for applying a charging voltage to said hollow and electrically conducting roller; and said hollow and electrically conducting roller and said insulating brush roller are driven together at a speed in synchronism with the material to be charged;

wherein the insulating brush roller is constituted by an electrically conducting rotary shaft roller and an insulating brush on which hairs are implanted, and the ends of the hollow electrically conducting roller are secured by electrically conducting flange rings that are provided together with said rotary shaft roller as a unitary structure;

wherein in the surfaces of said flange rings are formed recessed portions and protruded portions maintaining a predetermined distance and extending in the axial direction, and both ends of said hollow and electrically conducting roller are secured onto the surfaces of the recessed portions and the protruded portions by resin rings;

wherein said resin rings have a volume resistivity of not smaller than $10^{15}$ Ω-cm.

* * * * *